United States Patent [19]

Bergeron

[11] Patent Number: 4,763,909

[45] Date of Patent: Aug. 16, 1988

[54] WHEEL OR SLIDE MOUNTING IN AN AMUSEMENT/EXERCISE FOOT MOUNTED DEVICE

[76] Inventor: Gaetan G. Bergeron, P.O. Box 1324, Assiniboia, Saskatchewan S0H 0B0, Canada

[21] Appl. No.: 62,593

[22] Filed: Jun. 16, 1987

[30] Foreign Application Priority Data

Jul. 15, 1986 [CA] Canada ..... 513799

[51] Int. Cl.[4] ..... A63C 17/04

[52] U.S. Cl. ..... 280/11.25; 280/11.27

[58] Field of Search ..... 280/11.23, 11.22, 11.27, 280/11.28, 11.25, 11.19

[56] References Cited

U.S. PATENT DOCUMENTS

| | | | |
|---|---|---|---|
| 216,687 | 6/1879 | Lewis | 280/11.25 |
| 864,622 | 8/1907 | Domis | 280/11.25 |
| 1,379,250 | 5/1921 | Clark | 280/11.25 |
| 2,165,996 | 7/1939 | Chiles | 280/11.115 |

*Primary Examiner*—John J. Love
*Assistant Examiner*—Richard Camby
*Attorney, Agent, or Firm*—Stanley E. Johnson

[57] ABSTRACT

An amusement occupant-propellable exercising device that has a platform intended to be securable to the foot of the user of the device and at least one glide set attached to the platform for travel along a surface. Each glide set is composed of a crank arm unit having a central shaft attached to the platform for pivotal movement about an axis transverse to the direction of travel, a pair of oppositely directed arms spaced apart from one another along the axis with one arm extending forwardly in the direction of travel and the other extending rearwardly. A stub axle projects outwardly from respective ones of the pair of arms and a surface traversing element such as a skate blade, wheel or the like is mounted on respective ones of the stub axles. The glide sets can be arranged with one or two under the toe portion of the boot and one or two under the heel. The platform may be a plate, a boot, a ski, a skateboard or the like.

14 Claims, 2 Drawing Sheets

WHEEL OR SLIDE MOUNTING IN AN AMUSEMENT/EXERCISE FOOT MOUNTED DEVICE

FIELD OF INVENTION

This invention relates generally to a roller mounted exercising device and will be described herein with particular reference to roller skates but, as it will be seen from the detailed description to follow, it is also applicable to other roller-type amusement and exersicing devices as well as certain types of ice skates.

BACKGROUND OF INVENTION

Roller skates and skate boards are common roller-type exercising devices and somewhat less common are skis having rollers mounted thereon for summer use. In most all instances the wheels are mounted on straight through axles that extend transversely across the platform or boot for the rider or user, as the case may be. In roller skates the axle is fixed to the sole of the boot and the wheels are in a fixed location at all times with respect to the boot sole. On skate boards the wheel axles are transverse to the board but are pivotally mounted whereby the board can be tilted to a limited extent with respect to one of the two sets of wheels.

In Canadian Pat. No. 197,629, issued Mar. 2, 1920 to Maurice Block there is disclosed a roller skate type device consisting of a plate attachable to the sole of a boot and wherein the wheels are mounted on a crank-type axle. The opposite ends of the crank project laterally respectively from opposite sides of the boot, one being at the front and the other near the rear. The central portion of the crank extends longitudinally of the boot or plate and is pivotally attached thereto so that the boot can be tilted from one side to the other. This tilting is used to steer the front wheel by way of a suitable linkage mechanism actuated by the tilting. The wheels, however, remain always in an upright position.

SUMMARY OF INVENTION

A principal object of the present invention is to provide an improved mounting for the wheels of a roller type amusement device, i.e. roller skates, skate boards, roller mounted skis and the like, whereby the board or boot, to which they are attached, can tilt and the wheels, at the same time, also tilt from the vertical a corresponding amount.

A further object of the present invention is to provide a wheel mounting with the pivot of the wheel on one side of the boot or board to which it is attached, as the case may be, to be offset from the pivot of the wheel on the other side whereby the wheel assemblies oscilate relative to the base on which they are mounted in travelling over a rough surface.

In accordance with the present invention there is provided a wheel carried platform used as an amusement or exercising device having at least a pair of front wheels and a pair of rear wheels with the centre of gravity of the weight being carried passing somewhere between the front and the rear wheels, an improved axle mounting for each of the pairs of the wheels comprising a crank arm having the central portion thereof pivotally attached to the occupant carrying support for pivotal movement about an axis transversely of the length thereof and a wheel mounting stub axle at each of opposite sides of the platform and offset from one another longitudinally along the length thereof.

DESCRIPTION OF DRAWINGS

The invention is illustrated by way of example with reference to the accompanying drawings wherein.

DESCRIPTION OF PREFERRED EMBODIMENT

Figure 1:
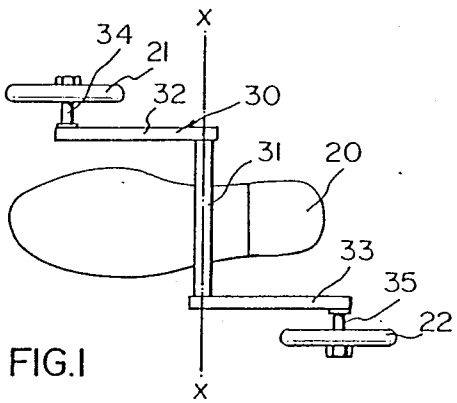
FIG. 1 is a bottom view of a roller skate having a pair of wheels with an axle mounting provided in accordance with the present invention.
Figure 2:
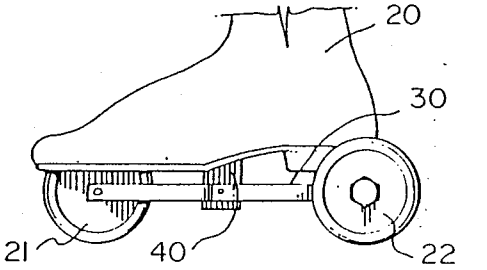
FIG. 2 is a side view of FIG. 1.
Figure 3:
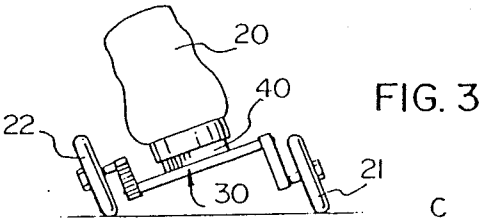
FIG. 3 is a rear view of the embodiment of FIGS. 1 and 2 showing the skate boot and wheels tilted as provided by the wheel axle mounting according to the present invention.

Referring to FIGS. 1 to 3 there is diagramatically illustrated a roller skate comprising a boot 20 carried by a pair of wheels 21 and 22 journalled on stub axles of a crank arm unit 30. Wheels 21 and 22 are on respective opposite sides of the boot 20 and offset from one another longitudinally of the length of the boot. The axle unit 30 is pivotally attached to the bottom of the boot by a journal designated 40 for pivotal movement about an axis designated X—X disposed transverse to the length of the boot.

The crank arm unit 30 has a central portion 31 journalled in bearing 40 with arms 32 and 33 respectively at opposite ends thereof. The arms are oppositely directed from the shaft 31 and are located respectively on opposite sides of the boot generally parallel to the length thereof. Arm 32 has a stub axle 34 on the free outer end thereof and wheel 21 is journalled on such stub axle. Similarly, arm 33 has a stub axle 35 with wheel 22 journaled thereon. The stub axles 34 and 35 are parallel to the crank arm central portion 31 and, as seen inside view in FIG. 2, the crank arm central portion 31, the arms 32 and 33 and stub axles 34 and 35 are in a common plane. Should one, however, wish to have the boot closer to the ground surface, or as in FIGS. 4 and 5 mount the crank arm units in pairs, crank arms 32 and 33 can be angularly related with respect to one another as, for example, illustrated in side elevational view in FIG. 10.

Figure 7:
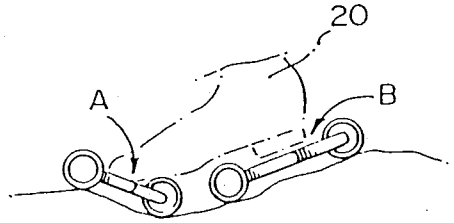
FIG. 7 is a side elevational view depicting the axle motion while traversing rough ground.

For convenience of description hereinafter crank arm unit 32 with wheels 21 and 22 thereon will be referred to as an "axle wheel set". The roller skate of FIGS. 1, 2 and 3 has only one such set and in FIG. 7 there is illustrated an embodiment consisting of two such axel wheel sets designated A and B located respectively under the toe and heel portion of the boot 20. Sets A amd B are spaced apart from one another longitudinally of the boot. With this arrangement, and wherein the wheels are offset in respective units A and B lengthwise of the boot, the effect of travelling over rough ground is minimized.

Figure 4:
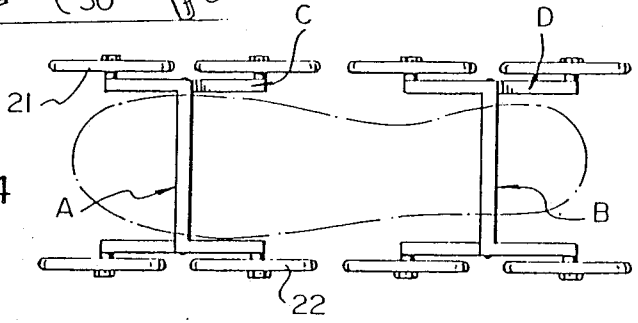
FIG. 4 is a top plan view of a multi-axle unit.
Figure 5:
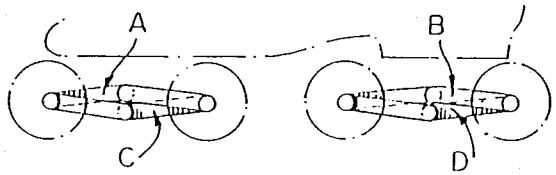
FIG. 5 is a side elevational view of FIG. 4.
Figure 10:
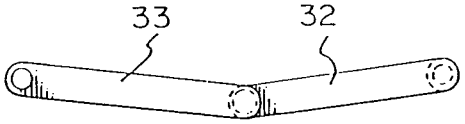
FIG. 10 is a side elevational view of FIG. 9.
Figure 6:
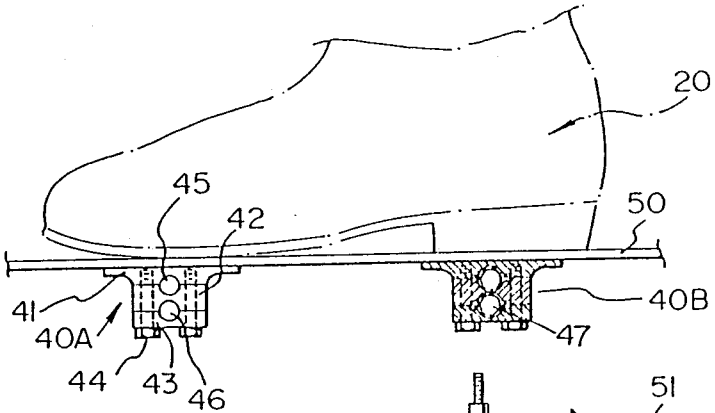
FIG. 6 is a side elevational view of the axle mounting bushings for a multi-wheeled unit provided in accordance with the present invention.
Figure 9:
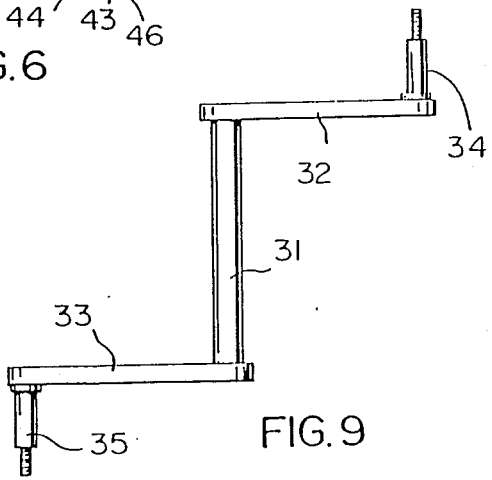
FIG. 9 is a top plan, enlarged view, of the crank arm axle unit.

A further embodiment is illustrated in FIGS. 4 to 6 and in this embodiment a pair of axle wheel sets is mounted under the toe portion of the boot and a second pair of axle wheel sets is mounted under the heel portion of the boot. Referring particularly to FIGS. 4 and 5 there is a front axle wheel set A and a rear axle wheel set B in FIG. 7 and at each position there is a second wheel set designated respectively C and D. The crank arm unit for each set is, as shown in FIG. 10, non-planar in side elevational view. In the pairs A and C the crank arm units 30 are inverted from one another whereby the respective central shafts 31 can be journalled one above the other while having all four wheels supporting the toe portion of the boot in a level state above the ground. Similarly the crank axle units of wheel sets B and D are inverted from one another as clearly illustrated in side elevational view in FIG. 5.

FIG. 6 illustrates journal blocks 40A and 40B attached to a plate 50 to which the boot 20 can be secured. Obviously the journal blocks 40A and 40B could be directly connected to or be part of the sole of the boot. Each journal block has a base portion 41 which is attached to the plate 50, an intermediate block 42 and a cap 43 retained in an assembled together relation by studs 44. The bearing blocks 40A and 40B provide a pair of journals 45 and 46 disposed one above the other for pivotally mounting the central portion 31 of the crank arm axle 30 of respective ones of the pair of axel wheel sets. A bearing insert 47 of rubber or a plastics material is provided for absorbing shock loads and ease in replacement when worn.

Figure 8:
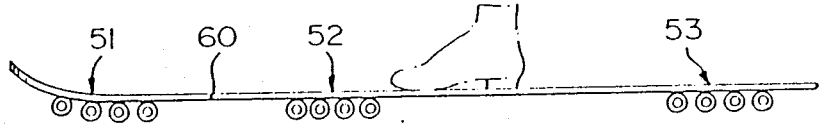
FIG. 8 is a side elevational view of a ski having multiple wheel sets mounted thereon in accordance with the present invention.

FIG. 8 illustrates a ski 60 having a plurality of axle wheel sets as, for example, illustrated in FIG. 4 mounted under the ski at positions designated 51, 52 and 53. Such an arrangement converts winter skis to summer use.

While in the foregoing there is described and illustrated in the drawings wheels 21 and 22 on each crank arm unit stub axle, such wheels can be replaced by short ice skate blades. In such an arrangement blade skates substituted for the wheels in the FIG. 4 embodiment would provide a bob-skate type employing applicant's novel axle mounting for the blades.

While no mention has been made of the construction of the wheels they could be of a plastics material, rubber or the like and may consist of, for example, a steel wheel with a hard rubber tire. FIG. 3 clearly illustrates the fact that when the boot is tilted the wheels also tilt a corresponding amount.

The device disclosed in the foregoing is an occupant-propellable exercising device which carries the occupant and in one embodiment wheels are mounted on the crank axles and in another embodiment short skate blades are substituted for the wheels. For description purposes herein the crank axle together with the wheels mounted thereon or the skate blades as the case may be, will be referred to as a glide set. Also, in one embodiment, the glide sets are shown attached directly to the sole of a boot and in another embodiment (FIG. 6) the glide sets are attached to a plate and in another embodiment (FIG. 8) the glide sets are attached to a ski. Again for convenience of description and in the claims that follow, whether it be a boot, a plate, or a ski the same is referred to as a platform.

I claim:

1. An amusement occupant-propellable exercising device comprising (a) a platform intended to be securable to the foot of the user of the device; and (b) at least one glide set attached to said platform for travel along a surface, each said glide set comprising a crank arm unit having a central shaft pivotally attached to the platform for pivotal movement about an axis transverse to the direction of travel, a pair of oppositely directed arms spaced apart from one another along said axis and secured to respective opposite ends of said shaft with one arm extending forwardly in the direction of travel and the other extending rearwardly, a stub axle secured to and projecting outwardly from respective ones of said pair of arms and a surface traversing element mounted on respective ones of said stub axles.

2. A device as defined in claim 1 wherein the surface traversing element is a wheel.

3. A device as defined in claim 1 including a pair of glide sets.

4. A device as defined in claim 3 wherein said pair of glide sets are spaced apart from one another in a direction longitudinally of said platform.

5. A device as defined in claim 1 including a front pair and a rear pair of glide sets and wherein the surface traversing elements are wheels.

6. In an occupant propellable exercising device having at least a pair of front wheels and a pair of rear wheels, an improved axle mounting for each of the pairs of wheels comprising a crank arm having a central portion thereof pivotally attached to an occupant carrying support platform for pivotal movement about an axis generally transversely of the direction of travel during use, an arm located at each of opposite ends of said central portion and secured thereto with one extending forwardly and the other rearwardly, a wheel mounting stub axle secured to and projecting outwardly from the respective arms with such stub axles being offset from one another longitudinally along the length of the platform and a wheel journalled on respective ones of said stub axles.

7. A device as defined in claim 6 including two such wheel and axle units at each of the front and rear locations.

8. A device as defined in claim 6 wherein said support is a boot.

9. A device as defined in claim 6 wherein said support is a ski and includes a plurality of said wheel and axle units mounted on the underside thereof.

10. A device as defined in claim 6 wherein the arms and central portion of the axle lie in the same plane.

11. A device as defined in claim 7 wherein the arms in each axle unit are disposed at an obtuse angle with respect to one another.

12. An amusement occupant propellable exercising device comprising (a) a platform for use underfoot of the user of the device; and (b) two or more glide sets located on the underside of the said platform and adapted for travel along the ground or street surface, each said glide set comprising (and) a crank arm unit having a central shaft pivotally attached to the platform for pivotal movement about an axis transverse to the direction of travel of the device during use, a pair of oppositely directed arms secured to said central shaft and spaced apart from one another longitudinally therealong with one arm extending forwardly in the direction of travel and the other extending rearwardly, a stub axle secured to and projecting outwardly from respective ones of said pair of arms and a surface transversing element comprising a wheel, roller or the like mounted on respective ones of said stub axles.

13. A device as defined in claim 12 wherein the two oppositely directed arms on each shaft are disposed at an angle to one another.

14. A device as defined in claim 13 including a front pair of glide sets and a rear pair of glide sets spaced apart from one another in a direction longitudinally of said platform and wherein the central shafts in each pair of glide sets are mounted one on top of the other.

* * * * *